United States Patent [19]

McGuckin et al.

[11] Patent Number: 5,026,629

[45] Date of Patent: Jun. 25, 1991

[54] FIXING BATH FOR BLACK AND WHITE PHOTOGRAPHIC ELEMENTS

[75] Inventors: Hugh G. McGuckin, Rochester; Michael G. Blount, Rochester; Paul Schivartz, Webster; Donald F. McLaen, Rochester; James L. Lyon, Holcomb, all of N.Y.

[73] Assignee: Eastman Kodak Company, Rochester, N.Y.

[21] Appl. No.: 476,203

[22] Filed: Feb. 7, 1990

[51] Int. Cl.[5] ..... G03C 5/24

[52] U.S. Cl. ..... 430/428; 430/429; 430/455

[58] Field of Search ..... 430/428, 429, 455

[56] References Cited

U.S. PATENT DOCUMENTS

| | | | |
|---|---|---|---|
| 3,708,299 | 1/1973 | Shimamura et al. . | |
| 4,209,583 | 6/1980 | Berthold et al. | 430/429 |
| 4,741,991 | 5/1988 | Wuelfing, Jr. . | |

FOREIGN PATENT DOCUMENTS

| | | | |
|---|---|---|---|
| 2633207 | 2/1977 | Fed. Rep. of Germany . | |
| 3311432 | 9/1983 | Fed. Rep. of Germany . | |
| 352092 | 12/1985 | Fed. Rep. of Germany . | |
| 0040943 | 4/1974 | Japan | 430/428 |
| 56-083735 | 7/1981 | Japan . | |
| 57-125939 | 8/1982 | Japan . | |
| 58-105145 | 6/1983 | Japan . | |
| 59-079244 | 5/1984 | Japan . | |
| 59-214855 | 12/1984 | Japan . | |
| 60-162255 | 8/1985 | Japan . | |
| 60-263938 | 12/1985 | Japan . | |
| 62-127741 | 6/1987 | Japan . | |
| 62-177552 | 8/1987 | Japan . | |
| 1138842 | 1/1969 | United Kingdom . | |

*Primary Examiner*—Charles L. Bowers, Jr.
*Assistant Examiner*—Thomas R. Neville
*Attorney, Agent, or Firm*—Robert A. Gerlach

[57] ABSTRACT

A fixing bath and a method of fixing wherein the bath contains an imidazole compound that facilitates the removal of thiosulfate from the film in addition to reducing the presence of stain in the resulting film.

17 Claims, No Drawings

FIXING BATH FOR BLACK AND WHITE PHOTOGRAPHIC ELEMENTS

BACKGROUND OF THE INVENTION

1. Field of the Invention

This invention relates to fixing baths for the removal of silver halide from unexposed portions of black and white photographic elements and to a method of fixing unexposed portions of black and white elements. More particularly, this invention relates to an improvement in fixing baths for black and white photographic elements whereby stain problems are eliminated and thiosulfate is removed from the fixed element.

2. Description of Related Art

Japanese Kokai No. Sho 49(1974) 40943 discloses a bleach fixing composition containing an iron(III) complex, a water-soluble silver halide fixing agent and an imidazole compound wherein the imidazole compound is used in extremely large quantities (the lowest amount being 40 g/L) with respect to the total quantity of the liquid fixing bath. The purpose for the imidazole compound is to prevent the precipitation of the iron(II) complex salt when various chemicals are added to the solution.

With the advent of automatic processors for the development of photographic elements and the printing of photographic images, the requirements for the various baths utilized in these procedures has become more stringent. Since these devices are generally continuous type devices wherein the element is introduced at one point and extracted from another, speed is an important factor. Secondly, the processors themselves must be capable of developing and printing photographic films and papers of all of the various manufacturers. Thus, the various solutions used in the different tanks of the processor must be capable of bringing about the desired result regardless of the origin of the product introduced, said product being the photographic imaging element of any of the commercially available manufacturerers. Thus, in the practice of developing photographic elements, whether it is by a manual technique or in an automatic processor, the solutions employed must be uniformly applicable to all elements without introducing unwanted disadvantageous characteristics to any particular one. Further, the processor and the various solutions used therein must be capable of achieving the desired result for example, the fixer must be capable of removing the silver halide from unexposed regions of the element in a rapid manner without adversely affecting either the appearance or archival stability of the resulting product.

While the primary function of the fixing bath is to remove the unexposed silver halide salt, it is necessary that the thiosulfate ion which is incorporated in the fixing bath to accomplish this purpose, also be removed as rapidly and completely as possible. Retained thiosulfate ion in the element is a factor in shortening archival life. Thus, it is a requirement that this material be thoroughly removed during the processing thereof.

Another requirement in the processing of black and white film is that any of the dyes employed in the preparation of the film, whether they be sensitizing dyes, antihalation dyes which are generally incorporated in the pelloid layer of the film, or the like, not interfere with the appearance or performance of the product. With the advent of high speed automatic processors, this becomes a more stringent requirement because high solution concentrations are employed and less time is available for each cycle of the processor. Should such dyes remain in the film, their presence is manifest by what is commonly referred to as "dye stain". Residual sensitizing dye stain is often more severe where the silver halide grains of the element have a large surface area. This is a discoloration of the processed film and can be clearly demonstrated by fixing an unexposed film and observing the result thereof.

In addition, any alteration in the ingredients employed in the processing of black and white film which will permit fast cycles through the processing bath is desirable.

SUMMARY OF THE INVENTION

The invention provides a fixing bath for black and white photographic elements consisting essentially of a thiosulfate fixing agent and an effective amount of an imidazole compound to reduce the retained thiosulfate ion concentration in micrograms/cm$^2$ of the processed element to less than one-half the value of the same fixing bath without the imidazole. That is, the invention contemplates adding a sufficient amount of an imidazole compound to a thiosulfate fixing bath in order to quickly lower the retained thiosulfate ion concentration to a point below which the retained thiosulfate will interfere with archival properties.

DESCRIPTION OF PREFERRED EMBODIMENTS

In the practice in accordance with this invention, any suitable imidazole compound may be employed such as, those having the formula

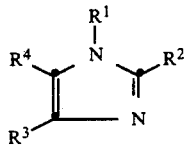

wherein $R^1$, $R^2$, $R^3$ and $R^4$ are hydrogen, halogen, amino, alkyl of 1 to 5 carbon atoms, haloalkyl of 1 to 5 carbon atoms, or hydroxyalkyl of 1 to 5 carbon atoms and $R^3$ and $R^4$ when taken together represent the atoms necessary to complete a fused carbocyclic ring. Representative examples include imidazole, benzimidazole, substituted imidazole compounds, such as for example, 2-methylimidazole, 2-chloroimidazole, 2-aminoimidazole, 4-methylimidazole, 2-ethylimidazole, 2-butylimidazole, 2-ethyl-4-methylimidazole, 4-(hydroxy methyl) imidazole hydrochloride, 1,2-dimethylimidazole, 4-chloroethyl imidazole, benzimidazole, substituted benzimidazoles such as for example, 5-methylbenzimidazole, 2-methylbenz-imidazole, 2-hydroxyethylbenzimidazole, 5-carboxybenzimidazole, 2-benzimidazole urea, 2-hydroxybenzimidazole, 2-phenyl-4,5-dihydroimidazole, 5-butylbenzimidazole, and the like.

While any suitable quantity of the particular imidazole compound may be added to the fixing bath to reduce the retained thiosulfate concentration to an acceptable amount, an amount of from about 2 to about 20 grams per liter is preferred and an amount from about 10 to about 15 grams per liter of fixing bath is most preferred. Thus, in a fixing bath containing amongst other ingredients, a major portion of a thiosulfate such as sodium thiosulfate, ammonium thiosulfate, potassium thiosulfate, mixtures of the above or the like, which is diluted to one liter by the addition of water, the imidazole compound is added in the amounts specified above. In addition to the water and thiosulfate, other ingredients may be employed for various known reasons in the photographic fixing art including for example, glacial acetic acid, sodium hydroxide, sodium sulfite, ammonium sulfite, sodium metabisulfite, sodium tetraborate, and the like. The addition of the imidazole compound to the fixing baths of black and white photographic imaging members, brings about the reduction in the concentration of retained thiosulfate to less than one-half the value of a comparable fixing bath without the presence of the imidazole compound and in most cases to less than one-tenth the value without the presence of the imidazole compound.

The presence of the imidazole compound in the fixing bath exhibits another and desirable effect with regard to the development and fixing of black and white photographic imaging members. In many instances, these imaging members exhibit upon development and fixing, staining which is believed due to the presence of retained sensitizing dyes in the silver halide emulsion and/or dyes present in the pelloid layer of the film which are present generally for anti-halation purposes. While this disadvantage can evidence itself in all types of development processes, it is usually most serious in photographic elements developed in automatic roll transport processors. Some factors that may have an influence on this staining phenomenon include, the surface area of the silver halide grains employed, the concentration and chemical structure of the various dyes employed in the coated layers of the photographic elements, the stages employed in the automatic processors and the shortened dwell time in the various stages. Further, since all types of all manufacturers films and papers are designed to be processed through the same automatic processors without alteration of the various baths employed therein, there is a need for processing chemicals and methods which will provide uniform results regardless of the particular brand of the photographic elements being processed. The processing of photographic film, which includes developing, fixing, etc. is generally conducted in an automatic processor such as for example, a Hope Model 152, a Versamat V-11 or the like both of which are roll transport type machines. Once again, while the invention is particularly applicable to automatic processing used in the development of black and white photographic elements, it is also advantageous in manual processing techniques to prevent dye staining and to reduce thiosulfate ion concentration.

The invention is further illustrated by the following examples:

EXAMPLE 1 (CONTROL)

Preparation of a Fixing Solution

In a first container, about 125 grams of demineralized water, about 98 grams of glacial acetic acid, about 41 grams of a 50% solution of sodium hydroxide, about 24 grams of sodium metabisulfite, about 45 grams of sodium tetraborate-pentahydrate and about 986 grams of a mixture of 57 weight percent of ammonium thiosulfate and 4 weight percent of ammonium sulfite, the balance being water are intimately mixed together at about 80° F. in order to give a solution having a pH of about 5.1.

In a second container is mixed about 948 grams of a 25% by weight solution of aluminum sulfate in water, about 148 grams of 93% sulfuric acid and about 206 grams of cold tap water.

About 250 milliliters of the solution from the first container is mixed with 28 milliliters of the solution from the second container and this mixture is diluted with water to provide one liter of fixer solution.

EXAMPLE 2

To one liter of the fixing solution prepared in accordance with Example 1, is added 15 grams of imidazole.

EXAMPLE 3

Each of five types of Kodak black and white film are processed in a Hope Processor Model 152, the film being unexposed and the developer employed in the Hope Processor being Kodak DURAFLO RT Developer. The Model 152 Hope Processor is operated in accordance with the commercially practiced methods as provided in the instructions therefor. In Table 1, the retained thiosulfate in each case is measured by the methylene blue method (ANSI Standard PH 1.28-1981, PH 1.41-1981) and is reported in micrograms per square centimeter. The measurements are made after five runs utilizing the fixer solution of Example 1, the fixing solution of Example 2 and finally a fixing solution prepared by adding 15 grams of imidazole per liter to the fixing solution of Example 1 after it has been employed for five runs. The concentration of retained thiosulfate is indicated in Table 1 and clearly illustrates the improved reduction in thiosulfate concentration employing the practice of the invention.

TABLE 1

| | Retained Thiosulfate in Micrograms/cm$^2$ | | |
|---|---|---|---|
| | Fixer of Example 1 (Control) | Fixer of Example 2 | Fixer of Example 1 +15 g/l Imidazole Added After 5 Runs |
| T-MAX 100 (35MM) | 9.0 | 0.8 | 0.8 |
| T-MAX 400 (35MM) | 15.0 | 1.1 | 0.9 |
| PLUS-X (35MM) | 15.5 | 5.4 | 6.8 |
| TRI-X (35MM) | 11.0 | 0.9 | 0.8 |
| T-MAX P3200 (35MM) | 11.2 | 1.0 | 1.0 |

EXAMPLE 4

In this Example, Kodak T-MAX 100 Film is sensitometrically exposed through a step filter and processed in a Hope Model 152 Processor, the developer being Kodak DURAFLO RT Developer. The fixing bath in each case is the fixing solution of Example 1 to which is added the quantity of imidazole set forth in Table 2. Prior to processing these films, each bath is seasoned by processing ten 8 by 10 inch sheets of Kodak T-MAX 400 film to arrive at a silver concentration in solution of one gram per liter as measured by atomic absorption. The density of the stain present after processing of each film utilizing the fixer containing the various concentrations of imidazole is measured through a green Wratten 93 filter as the stain is magenta in color. The silver content of all of the samples after fixing in accordance with this Example is 0.00 milligrams/square foot as measured by x-ray fluorescence. Table 2 sets forth the improvement in the reduction in staining as the concentration of imidazole in the fixing solution increase from 0 to 20 grams per liter.

TABLE 2

| Imidazole Concentration g/l | Green Filter Density |
|---|---|
| 0.0 (control) | 0.35 |
| 1.25 | 0.35 |
| 2.50 | 0.34 |
| 5.0 | 0.32 |
| 10.0 | 0.27 |
| 15.0 | 0.24 |
| 20.0 | 0.24 |

EXAMPLE 5

The procedure of Example 4 is repeated, however, benzimidazole is employed in the concentrations set forth in Table 3 rather than imidazole as in Example 4.

TABLE 3

| Benzimidazole Concentration g/l | Green Filter Density |
|---|---|
| 0.0 | 0.34 |
| 5.0 | 0.31 |
| 10.0 | 0.29 |
| 15.0 | 0.25 |

EXAMPLE 6

In this Example, various Kodak black and white films as indicated in the Table 4 are processed as in Example 4 utilizing the fixer of Example 1 as the control and the fixing bath of Example 2. The results of the density measurements for each of the films demonstrates an improvement when practicing in accordance with this invention.

TABLE 4

| | Green Filter Densities | | Fixer of Example 1 + 15 g/l Imidazole Added After 5 Runs |
|---|---|---|---|
| | Fixer of Example 1 (Control) | Fixer of Example 2 | |
| T-MAX 100 (35MM) | 0.36 | 0.24 | 0.25 |
| T-MAX 400 (35MM) | 0.33 | 0.28 | 0.29 |
| T-MAX P3200 (35MM) | 0.37 | 0.32 | 0.32 |
| T-MAX (SHEET FILM) | 0.21 | 0.07 | 0.08 |

EXAMPLE 7

In this Example, an unexposed Kodak T-MAX 100 Film is manually rocked in a tray containing the fixing bath in accordance with Example 1 as the control and in the remaining experiments the fixing bath is that of Example 1 to which has been added 15 grams per liter of the imidazole compound set forth in Table 5. In each case the time of fixing is 1.25 minutes, the fixing solution is maintained at room temperature or approximately 70° F. and the film is then washed in water for 5 minutes at 68° F. The average diffuse transmission density through a Wratten 93 Green Filter for six measurements is indicated for each compound.

TABLE 5

| Additive to Fixing Bath (15 g/l) | Green Filter Density |
|---|---|
| 2-methylimidazole | 0.29 |
| 4-methylimidazole | 0.30 |
| 2-ethylimidazole | 0.30 |
| 2-ethyl-4-methylimidazole | 0.27 |

TABLE 5-continued

| Additive to Fixing Bath (15 g/l) | Green Filter Density |
|---|---|
| 1,2-dimethylimidazole | 0.31 |
| 2-methylbenzimidazole | 0.33 |
| 2-benzimidazoleethanol | 0.35 |
| Fixer Example 1 (Control) | 0.44 |

The invention has been described in detail with particular reference to preferred embodiments, but it will be understood that variations and modifications can be effected within the spirit and scope of the invention.

What is claimed is:

1. A photographic fixing bath for black and white light sensitive elements consisting essentially of an aqueous solution of a thiosulfate fixing agent and an effective amount of an imidazole compound to reduce the retained thiosulfate ion concentration of the film to less than one-half the value utilizing a fixing bath without the presence of imidazole compound.

2. The photographic fixing bath of claim 1 wherein the imidazole compound has the formula

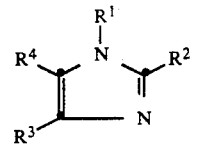

wherein $R^1$, $R^2$, $R^3$ and $R^4$ are hydrogen, halogen, amino, alkyl of 1 to 5 carbon atoms, haloalkyl of 1 to 5 carbon atoms, or hydroxyalkyl of 1 to 5 carbon atoms and $R^3$ and $R^4$ when taken together represent the atoms necessary to complete a fused carbocylic ring.

3. The photographic fixing bath of claim 1 wherein the imidazole compound is imidazole.

4. The photographic fixing bath of claim 1 wherein the imidazole compound is benzimidazole.

5. A photographic fixing bath for black and white light sensitive elements consisting essentially of an aqueous solution of a thiosulfate fixing agent and from about 2 grams per liter of fixing solution to about 20 grams per liter of fixing solution of an imidazole compound.

6. A photographic fixing bath of claim 5 wherein the imidazole compound has the formula

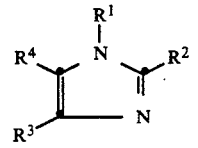

wherein $R^1$, $R^2$, $R^3$ and $R^4$ are hydrogen, halogen, amino, alkyl of 1 to 5 carbon atoms, haloalkyl of 1 to 5 carbon atoms, or hydroxyalkyl of 1 to 5 carbon atoms and $R^3$ and $R^4$ when taken together represent the atoms necessary to complete a fused carbocylic ring.

7. The photographic fixing bath of claim 5 wherein the imidazole compound is imidazole.

8. The photographic fixing bath of claim 5 wherein the imidazole compound is benzimidazole.

9. The fixing bath of claim 5 wherein the imidazole compound is present in an amount of from about 5 to about 15 grams per liter.

10. The fixing bath of claim 5 wherein the imidazole compound is present in an amount of from about 10 to about 15 grams per liter.

11. In the method of processing a black and white photographic element including the steps of developing, fixing and washing, the improvement which comprises reducing dye stain and retained thiosulfate ion concentration by fixing with an aqueous solution consisting essentially of a thiosulfate fixing agent and an effective amount of an imidazole compound.

12. The method of claim 11 wherein the imidazole compound has the formula

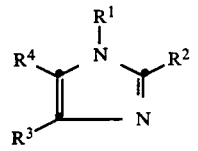

wherein $R^1$, $R^2$, $R^3$ and $R^4$ are hydrogen, halogen, amino, alkyl of 1 to 5 carbon atoms, haloalkyl of 1 to 5 carbon atoms, or hydroxyalkyl of 1 to 5 carbon atoms and $R^3$ and $R^4$ when taken together represent the atoms necessary to complete a fused carbocylic ring.

13. The method of claim 11 wherein the imidazole compound is imidazole.

14. The method of claim 11 wherein the imidazole compound is benzimidazole.

15. The method of claim 11 wherein the imidazole is present in an amount of from about 2 to about 20 grams per liter of aqueous fixing solution.

16. The method of claim 11 wherein the imidazole is present in an amount of from about 5 to about 15 grams per liter of aqueous fixing solution.

17. The method of claim 11 wherein the imidazole is present in an amount of from about 10 to about 15 grams per liter of aqueous fixing solution.

* * * * *